US006087571A

United States Patent [19]

Legere

[11] Patent Number: 6,087,571

[45] Date of Patent: Jul. 11, 2000

[54] ORIENTED POLYMER REEDS FOR MUSICAL INSTRUMENTS

[75] Inventor: Guy Legere, Barrie, Canada

[73] Assignee: Légére Reeds Ltd., Barrie, Canada

[21] Appl. No.: 09/248,902

[22] Filed: Feb. 12, 1999

Related U.S. Application Data

[60] Provisional application No. 60/075,175, Feb. 19, 1998.

[51] Int. Cl.[7] ..... G10D 9/02

[52] U.S. Cl. ..... 84/383 A; 84/350; 84/363

[58] Field of Search ..... 84/383 A, 383 R, 84/350, 363

[56] References Cited

U.S. PATENT DOCUMENTS

| | | | |
|---|---|---|---|
| 1,779,522 | 10/1930 | Widmayer . | |
| 2,296,737 | 9/1942 | Peterson | 84/383 |
| 2,919,617 | 1/1960 | Brilhart | 84/383 R |
| 3,165,963 | 1/1965 | Burns | 84/383 |
| 3,267,791 | 8/1966 | Roberts | 84/383 |
| 3,340,759 | 9/1967 | Petzke | 84/383 |
| 3,420,132 | 1/1969 | Backus | 84/383 |
| 3,705,820 | 12/1972 | Knotik et al. | 117/93.31 |
| 3,759,132 | 9/1973 | Backus | 84/383 |
| 3,905,268 | 9/1975 | Gamble | 84/383 |
| 4,014,241 | 3/1977 | Gamble | 84/383 A |
| 4,145,949 | 3/1979 | Kilian | 84/383 A |
| 4,268,470 | 5/1981 | Capaccio et al. | 528/502 |
| 4,282,277 | 8/1981 | Austen et al. | 428/36 |
| 4,337,683 | 7/1982 | Backus | 84/383 A |
| 4,355,560 | 10/1982 | Shaffer | 84/383 A |
| 4,655,679 | 4/1987 | Giacomel | 415/90 |
| 4,850,925 | 7/1989 | Ady | 446/207 |
| 4,979,420 | 12/1990 | Cusack et al. | 84/383 A |
| 5,030,402 | 7/1991 | Zachariades | 264/138 |
| 5,227,572 | 7/1993 | Cusack et al. | 84/383 A |
| 5,399,308 | 3/1995 | Woodhams et al. | 264/210.2 |
| 5,542,331 | 8/1996 | Hartmann et al. | 84/383 A |

OTHER PUBLICATIONS

Ward, I.M., Structure and Properties of Oriented Polymers, Applied Science Publishers Ltd. 1975, pp. 77–116.

Burke, P.E., Weatherly, G.C. and Woodhams, R.T., Uniaxial Roll–Drawing of Isotactic Polypropylene Sheet, Polymer Engineering and Science, Mid–Apr. 1987, vol. 27, No. 7, pp.518–523.

*Primary Examiner*—Robert E. Nappi
*Assistant Examiner*—Shih-yung Hsieh
*Attorney, Agent, or Firm*—Philip C. Mendes de Costa; Bereskin & Parr

[57] ABSTRACT

A synthetic reed for use in reed-blown wind instruments such as the clarinets, saxophones, oboes and bassoons may be made from an oriented thermoplastic material such as uniaxially or biaxially oriented polypropylene. The reed may be machined from an oriented-polymer blank which in turn has been cut or stamped from an oriented-polymer sheet of the appropriate thickness.

22 Claims, No Drawings

ORIENTED POLYMER REEDS FOR MUSICAL INSTRUMENTS

This application claims benefit of Provisional Application Ser. No. 60/075,175, filed Feb. 19, 1998.

FIELD OF THE INVENTION

This invention relates to a synthetic reed for wind instruments.

BACKGROUND OF THE INVENTION

Reed-blown wind instruments include the clarinet, saxophone, oboe and bassoon. In single reed instruments such as the saxophone and clarinet, a vibrating plate, clamped to the mouthpiece, sets up a standing wave in the barrel of the instrument, and the frequency of these waves is controlled by the musician. The vibrating plate is called the reed, and it is normally made of a natural cane material. The musician creates the vibration by blowing into the gap between the reed and the mouthpiece, which creates and maintains a standing wave in the barrel of the instrument. In the oboe and bassoon, a double reed is used.

Natural cane is the preferred material for the construction of reeds. Apparently, the material properties of natural cane are ideal for the construction of reeds, and reeds made of this material are generally acknowledged to be superior to those made of other materials. Nevertheless, natural cane reeds have many disadvantages. Because the material comes from a natural source, there is a variation in material properties which results in a variation in playing characteristics. Thus, not every reed purchased will be found suitable for playing. Secondly, the reed is hygroscopic, and must be extensively conditioned by exposing it to water prior to playing. Thirdly, cane is prone to splitting along the grain, which causes the reed to become unplayable. Fourthly, the reed material gradually breaks down under the influence of high frequency, low amplitude fatigue to which it is subjected.

As a result of these deficiencies, many inventors have proposed modifications of the reed structure. There have been three basic approaches to produce improved reeds: treatment of natural cane, alternative materials, and alternative materials together with a modified reed configuration.

There is considerable uncertainty in the literature regarding the material properties and configuration required to produce acceptable tonal quality. As a result, in one approach, discussed in U.S. Pat. Nos. 3,340,759, 3,705,820 and 4,145,949, synthetic coatings and penetrating resins are used on the natural cane reed to improve its resistance to water and its durability. Not all of the deficiencies of natural cane are addressed through these methods, however, and so alternative materials and reed configurations have been proposed.

The second principle method of creating an improved reed is to use a material with properties similar to those of cane. However, there is considerable confusion in the literature as to which material and structural properties are important. U.S. Pat. No. 3,420,132 suggests that the stiffness, density and viscous damping are the important material properties, and also discusses several features of the configuration that control the sound quality. U.S. Pat. No. 3,759,132 cites the properties of wet cane, suggesting that these are more important than the properties of dry cane. In U.S. Pat. No. 3,905,268 the ratio of elastic modulus/mass is cited as being important. Furthermore, U.S. Pat. No. 4,355,560 suggests that the individual modulus and density need not be similar to those of cane, provided the ratio of modulus to density (termed the "acoustic impedance") is similar to that of cane. U.S. Pat. No. 4,014,241 suggests that elastic modulii both transverse and parallel to the long axis of the reed are important. The importance of viscous damping is discussed in U.S. Pat. Nos. 3,420,132, 4,337,683, and 5,542,331, but many other patents ignore this property. In U.S. Pat. No. 5,542,331, a means of controlling damping through the inclusion of special damping materials such as hollow fibres is disclosed. U.S. Pat. No. 5,227,572 suggests that the tone of a titanium reed can be controlled by heat treatment to alter the hardness. In this same patent, the failure of previous metal reeds to simulate the "fibratory response of cane" was attributed to the "ductal nature of the metal".

The preceding discussion indicates that there is considerable confusion in the art about the important properties of cane for reproducing the tonal qualities of a natural cane reed.

None of the polymers known in the art with a density sufficiently low to match that of either wet or dry cane have an elastic modulus which is as high as that of either wet or dry cane in the fibre direction. For example, isotropic polypropylene, with a density of approximately 0.91 g/mL, has an elastic modulus of approximately 1.0 to 1.6 GPa, less than one third the modulus of cane. Polymer-composite materials having sufficient modulus, such as carbon fibre reinforced epoxy, generally have higher densities, as do all metals. In fact, U.S. Pat. No. 3,759,132 teaches that common plastics are unsuitable because of their low modulus and relatively high density, and that composite materials such as glass fibre reinforced plastic are difficult to use because they tend to split. A review of a broad materials database such as the database found in the Cambridge Materials Selector (Cambridge Materials Selector, Version 2.02, Granta Design, Cambridge, U.K.) reveals that there are no commonly available polymers, metals, ceramics or composites with comparable elastic modulus and density to that of wet or dry cane. The density of polymers and composites can be reduced by inclusion of hollow elements, such as hollow glass microballoons. For example, U.S. Pat. No. 4,337,683 proposes the use of graphite/epoxy composite ribs spaced with epoxy/microballoon composite regions to achieve the desired bending stiffness and mass for the reed. U.S. Pat. No. 3,759,132 suggests the use of metal ribs spaced with low density material for the same purpose. However, U.S. Pat. No. 3,420,132 teaches that the last ¼ to ⅜ of an inch of the very tip of the reed controls the elastic response. In this region, the tip may be as thin as 100 $\mu$m (100 micrometers or 0.004"), and hence complicated ribbed or shaped structures are very difficult to obtain in a reproducible way.

Many investigators consider the linear mass distribution and overall bending stiffness to be more important than the modulus and density of the material used to manufacture the reed, leading to the third principle method of creating an improved reed. These investigators have suggested an overall reed shape which is different to that of the conventional reed in order to deliver the required bending stiffness and mass distribution. Even with materials of low modulus and/or higher density than cane, the bending stiffness to mass ratio can be made equivalent to that of a cane reed by an increase in the cross-sectional moment of inertia. For example, U.S. Pat. No. 3,905,268 suggests an arched transverse cross-section with longitudinal ridges to produce a higher moment of inertia than that of the conventional cane reed cross-section. In U.S. Pat. No. 4,014,241, a multitude of longitudinal channels are used in a synthetic material, in order to match both the longitudinal and transverse bending stiffness of a cane reed. Cane is anisotropic, with a longitudinal modulus substantially greater than the transverse modulus.

The failure of these patents to reveal an ideal synthetic reed is clearly evidenced by the relative scarcity of such products in the commercial market and the widespread preference among accomplished musicians for conventional cane reeds. Clearly the vibration modes are so complex that attempts to produce acceptable reeds with nonstandard cross-sectional shapes have failed to produce a reed which satisfactorily mimics the behaviour of the natural cane reed. Complex geometries and materials combinations are very difficult to achieve in the extremely thin tip of the reed that apparently dominates the vibration response.

SUMMARY OF THE PRESENT INVENTION

In accordance with the instant invention, there is provided a synthetic reed for reed-blown wind instruments made from uniaxially or biaxially oriented semicrystalline thermoplastics such as polyethylene and polypropylene. Surprisingly, it has been found that by selecting a material which has substantially the same modulus and density as that exhibited by cane, preferably cane in the playing condition, a synthetic reed may be produced that has the same tonal properties as natural cane reeds. By machining this thermoplastic material into the shape and size of a conventional cane reed, a durable and water resistant reed with substantially the same acoustic properties has been produced. This reed is referred to herein as an Oriented Polymer Reed or OPR. Since the OPR does not absorb water, no preconditioning is required, other than to warm the reed up to the temperature of the mouth.

Pursuant to the instant invention, a method of manufacturing a synthetic reed for reed-blown wind instruments of conventional size and shape is provided. The method comprises the steps of:

(a) providing a blank of an oriented semi-crystalline polymer having a longitudinal modulus and density which are substantially the same as those of cane, preferably cane in its playing condition; and, (b) machining the blank to the shape and size of a conventional cane reed while maintaining the temperature in a substantial portion of the oriented polymer blank below the melting temperature of the polymer.

Surprisingly, the damping characteristics of the material have not been found to be important. The resonant frequency of the reed is much more important in determining the quality of the sound the instrument makes. The resonant frequency of the reed is the dominant frequency of vibration when the tip of the reed is plucked and allowed to freely vibrate in air. Preferably, the oriented polymer reed has a longitudinal modulus and density that are substantially the same as those of a cane reed in the playing condition such that a reed made from this material has a resonant frequency similar to that of cane in its playing condition.

In one aspect, the polymer is uniaxially oriented and the blank is machined so that the primary vibratory axis of the reed is parallel to the direction of orientation of the polymer. In another aspect, the polymer is biaxially oriented and the blank is machined so that the primary vibratory axis of the reed is parallel to one of the directions of orientation of the polymer, the synthetic reed having a modulus and/or strength (and preferably both) in a direction transverse to the primary vibratory axis higher than that of cane in the direction transverse to the fibre direction in a cane reed.

The oriented polymer sheet may be manufactured by any one of a number of processes which are capable of imparting orientation to the polymer molecules including hydrostatic extrusion, ram extrusion, tensile drawing, die drawing, compression molding, rolling, and roll-drawing. In such processes, the polymer is typically heated to a temperature below its melting point, extended in one or more directions to impart molecular orientation, and quenched to lock in said orientation. In some cases, orientation may also be obtained through flow induced crystallization during processing at temperatures greater than the melt temperature. Such oriented polymers have a tensile modulus much higher than their isotropic precursors, and can be produced with any specific modulus, up to a limit, by suitable control of the extent of orientation. By such processes, oriented-thermoplastic sheets with substantially the same density and modulus as natural cane in its playing condition can be produced. These sheets can then be machined into reeds which produce a sound similar to that produced when conventional cane reeds are used with reed-blown wind instruments. In addition, reeds manufactured from oriented thermoplastic sheets with similar modulus and density to those of cane in its playing condition have been found to have similar resonant frequencies to conditioned cane reeds when the tip is plucked and allowed to freely vibrate in air.

Pursuant to a preferred embodiment of this invention, a synthetic reed for reed-blown wind instruments comprises an oriented semi-crystalline thermoplastic material having a longitudinal modulus, and density which are substantially the same as cane in its playing condition, and this reed has a resonant frequency similar to that of a cane reed in its playing condition. The thermoplastic material may be uniaxially oriented or biaxially oriented. The thermoplastic material may be selected from the group consisting of polypropylene and polyethylene. The thermoplastic material may have substantial shrinkage in at least one direction upon heating to its melting temperature in an unrestrained state.

The shrinkage factor is approximately the same as the draw ratio used to orient the polymer, but does depend on the processing temperature and quenching conditions. As an example, a polymer which has been given a draw ratio of six in order to produce orientation and enhanced mechanical properties, will generally shrink by a factor of up to six upon heating to its melt temperature in an unrestrained state.

In one embodiment, the oriented semi-crystalline thermoplastic is uniaxially oriented and has a modulus in one direction similar to that of conditioned cane in the fibre direction, said polymer preferably having approximately the same modulus as its isotropic precursor in a plane having the draw direction as its normal vector, and the reed has a primary vibratory axis parallel to the direction of orientation of the thermoplastic material.

In another embodiment, the oriented semi-crystalline thermoplastic is biaxially oriented and has a modulus in one direction similar to that of conditioned cane in the fibre direction, and a modulus and/or strength in at least one transverse direction higher than that of cane in a direction transverse to the fibre direction, and the reed prepared from such material has a primary vibratory axis parallel to one of the directions of orientation of the thermoplastic material.

In another embodiment, the oriented isotactic polypropylene is uniaxially oriented and has a modulus in one direction similar to that of conditioned cane in the fibre direction, the oriented isotactic polypropylene has the approximately the same modulus as its isotropic precursor in all directions in a plane having the draw direction as its normal vector, and the reed has a primary vibratory axis parallel to the direction of orientation of the thermoplastic material.

In another embodiment, the oriented isotactic polypropylene is biaxially oriented, the synthetic reed has a primary vibratory axis parallel to one of the directions of orientation of the thermoplastic material, the synthetic reed has a modulus in one direction similar to that of conditioned cane in the fibre direction, and at least one of the modulus and strength of the synthetic reed in a direction transverse to the primary vibratory axis is higher than that of cane in a direction transverse to the fibre direction of the cane.

In a preferred embodiment of the current invention, a uniaxially oriented semi-crystalline thermoplastic sheet, approximately 4 mm thick with a density of 0.9–1.0 g/mL, a modulus in the draw direction of 5–10 GPa, and a resonant frequency similar to that of a conditioned cane reed is used. This material may be obtained by any one of a number of processes including hydrostatic extrusion, ram extrusion, tensile drawing, die drawing, rolling, or roll-drawing. The polymer type, molecular weight distribution, initial crystalline morphology, and draw conditions are selected to produce the required properties. The sheet material is cut into reed blanks with a length of approximately 90 mm and a width of approximately 20 mm. The blank's width is preferably tapered to match the tapering width of a conventional cane reed. These tapered blanks may be machined in a computer numerical controlled milling machine using a polycrystalline diamond cutter and water jet cooling to the dimensions of a conventional cane read.

In a second preferred embodiment of the current invention, a biaxially oriented semicrystalline sheet with a modulus in one direction of 5–10 GPa, but with a transverse strength and/or modulus substantially higher (e.g. at least about 50% higher) than the strength of natural cane transverse to the fibre direction is used to form the reed. A reed having such a higher strength may not match the acoustics of the cane reed perfectly, but will be much more durable since it will be more resistant to splitting than cane because of its high transverse strength.

DESCRIPTION OF PREFERRED EMBODIMENT

Sound producing reeds described in this patent may be used in any reed-blown wind instruments and are preferably used in the clarinet, saxophone, oboe, and bassoon. For each individual instrument, a conventional cane reed has a distinctive shape and size. Since the oriented polymer reeds are intended to be made from material which duplicates, as closely as possible, the mechanical properties of cane which have been found to control the quality of the sound, the shape and size of an OPR for any given instrument may be similar to that of the corresponding conventional cane reed and, preferably, are the same as those of the corresponding conventional cane reed.

Surprisingly, it has been found that synthetic reeds with substantially the same modulus and density as cane, preferably cane in the playing condition, may be prepared from oriented semicrystalline thermoplastics. The thermoplastic material may be either uniaxially or biaxially oriented and more preferably, it is primarily uniaxially oriented.

Thermoplastic materials which may be so used comprise those, which after orientation, have a density and a modulus similar to that of cane, preferably cane in its playing condition. The oriented thermoplastic may be semicrystalline. Preferably, the oriented thermoplastic has a density from about 0.8 to about 1.3 g/mL, more preferably a density from about 0.9 to about 1.1 g/mL and most preferably a density from about 0.9 to about 1.0 g/mL. Further, the oriented thermoplastic has a modulus in the draw direction from about 3 to about 14 GPa, more preferably from about 4 to about 12 GPa and most preferably from about 5 to about 10 GPa. The preferred thermoplastic materials are polyethylene or polypropylene. The most preferred material is isotactic polypropylene.

The elastic modulus of the polymer may be increased by orienting and extending the molecules in one or more directions. The degree of orientation can be closely controlled through the processing parameters, and hence a controlled modulus can be produced.

Polymer orientation can be accomplished by a class of processes which are generally termed "solid phase deformation processes". Typically, a semicrystalline thermoplastic polymer such as polyethylene or polypropylene is heated to a temperature below its melt temperature, subjected to an extensional flow field, and the temperature is rapidly reduced while the material is held in its extended state. Polymer orientation can also be accomplished in amorphous thermoplastics, but the degree of stiffness improvement obtained in semicrystalline thermoplastics is much greater, and these materials are more preferred for synthetic reed blanks. In some cases, polymer orientation can also be obtained during processes at temperatures above the melt temperature in semicrystalline thermoplastics by flow-induced crystallization.

In general, any process producing extensional flow can also be used to produce an oriented polymer which enhances stiffness provided the operating conditions are correct. For example, polypropylene billets may be heated to 155–160° C. in an oven, and fed through a four roll mill. The first two sets of rolls are heated, and the second set of rolls rotates more quickly than the first set, so that the material is pulled in tension between them, elongating and being reduced in both thickness and width. The third and fourth sets of rolls are at room temperature, and serve to provide traction and chilling. The result is a polymer strip with a degree of orientation dependent on the draw ratio. The draw ratio is equal to the length of the final drawn strip of polypropylene divided by the length of the original billet. The elastic modulus in the draw direction is a function of draw ratio, varying from about 1.0–1.6 GPa in the unoriented material, to about 16 GPa in the material processed with a draw ratio of 16. (Burke, P. E., Weatherly, G. C., Woodhams, R. T., Polym.Eg.Sci., 27, pp. 518–523, 1987). The relationship between draw ratio and modulus is a function of a number of other parameters such as molecular weight, initial crystallinity and crystalline morphology, processing temperature, etc.

Other methods for inducing uniaxial polymer orientation can be employed to produce anisotropic polymers with a modulus in the draw direction greater than that of the isotropic polymer. These include simple tensile drawing processes (U.S. Pat. No. 4,268,470), extrusion followed by tensile drawing of the hot extrudate (U.S. Pat. No. 5,399,308) and, solid-state extrusion (Zachariades, A. E., Mead, W. T., Porter, R. S., "Recent Developments in Ultramolecular Orientation of Polyethylene by Solid State Extrusion", in Ultra-High Modulus Polymers, ed. Ciferri, A., Ward, I. M., Applied Science Publishers, London, 1979).

The uniaxially oriented materials may be transversely isotropic, with enhanced properties in the draw direction and properties similar to those of the undrawn polymer in all directions in the plane transverse to the draw direction. In some processes, such as rolling or roll-drawing, extension is associated primarily with a reduction in thickness, with a lesser reduction in width, and these processes may lead to an orthotropic rather than transversely isotropic material. The transverse properties may also be increased or reduced by uniaxial orientation depending on the polymer grade and processing conditions. There are also a number of processes producing biaxial orientation which enhance properties in both principle directions of the plane of the sheet. For example, the BeXor™ process involves hydrostatic extrusion through an expanding annular die (U.S. Pat. No. 4,282,277). Compression molding a cylindrical billet of hot polymer between lubricated platens produces a polymer with molecular orientation in the plane of the sheet (U.S. Pat. No. 5,030,402). Cross-rolling a sheet also produces biaxial orientation.

A distinguishing characteristic of oriented semi-crystalline thermoplastics is that if they are heated to their melting temperature without any external restraint, they will contract in any direction where there is preferential orientation. Accordingly, uniaxially oriented sheets such as a roll-drawn strip of polypropylene, when so heated will shrink in the draw direction and expand in at least one principle axis transverse to the draw direction. Biaxially oriented sheets, such as those produced by compression molding, shrink in both planar directions and increase in thickness upon heating. According to this invention, all oriented thermoplastics which undergo such shrinkage upon heating may be used as a blank for machining wood-wind reeds.

Because heating causes entropic relaxation of the polymer, the process of machining the reed blank into a finished reed should be conducted without heating the polymer above its melting point. This can be accomplished by using a high speed steel cutter with water cooling or an air cooled polycrystalline diamond cutter.

By suitably choosing the orientation process, raw material, and processing conditions, it is possible to produce a synthetic reed with substantially the same density and elastic modulus as those of cane reeds and preferably conditioned (wet) cane reeds. Furthermore, synthetic reeds with a resonant frequency similar to that of a conditioned cane reed can be produced in this way. If required, the transverse modulus and/or strength of the oriented polymer reed can be set to be higher than that of the natural cane by a biaxial orientation process, to produce a reed which is more resistant to longitudinal splitting.

EXAMPLE

An extruded sheet of 12 mm thick semicrystalline isotactic polypropylene was cut into a billet approximately 2 inches wide and 7 inches long. The billet was placed in a convection oven at a temperature of 160° C. for one hour. The billet was rapidly removed from the oven and was quickly transferred to the grips of an Instron tensile testing machine at room temperature. The initial distance between the grips was 3 inches. Once secured in the grips, the specimen was elongated at a rate of 20 inches per minute, and the elongation was stopped when the final distance between the grips was 24 inches. The billet displayed a uniform draw, with reductions in both thickness and width approximately proportional to the original thickness and width, respectively. The nominal draw ratio is calculated as the final distance between the grips divided by the original distance between the grips, and for this example, the nominal draw ratio was eight. The drawn billet was cut into several lengths of approximately 90 mm, these pieces being the precursors for individual reeds, and hereinafter referred to as blanks. A blank from the centre of the drawn billet was planed with a helical cutter to a thickness of approximately 4 mm. The edges of the blank were tapered to match the tapered width of a conventional b-flat clarinet reed. The tapered blank was transferred to a three-axis computer contolled cutting machine, where it was held in place with a combination of vacuum and mechanical clamps. The cutting surface used was a polycrystalline diamond cutter spinning at approximately 20,000 r.p.m. The shape of the final reed was created using a predefined profile to drive the CNC machine, and was similar to that of a conventional b-flat clarinet reed. The finished blank was removed from the machine, and the tip and heel were trimmed to the desired point. The finished reed was given to a professional clarinet player for evaluation purposes. The reed proved to have a sound very similar to that of a good cane reed, and was considered to be much better than other synthetic reeds by the professional clarinet player.

I claim:

1. A method of manufacturing a synthetic reed of conventional size and shape for reed-blown wind instruments comprising the steps of (a) providing a blank of an oriented semi-crystalline polymer having a longitudinal modulus and density which are similar to those of cane; and, (b) machining the blank to the approximate shape and size of a conventional cane reed while maintaining the temperature in a substantial portion of the oriented polymer blank below the melting temperature of the polymer.

2. The method as claimed in claim 1 wherein the polymer has a longitudinal modulus and density which are substantially the same as cane in its playing condition.

3. The method as claimed in claim 1 wherein the polymer is uniaxially oriented and the blank is machined so that the primary vibratory axis of the reed is parallel to the direction of orientation of the polymer.

4. The method as claimed in claim 1 wherein the polymer is biaxially oriented and the blank is machined so that the primary vibratory axis of the reed is parallel to one of the directions of orientation of the polymer, the synthetic reed having at least one of the modulus and strength in a direction transverse to the primary vibratory axis higher than that of cane in the direction transverse to the fibre direction in a cane reed.

5. A synthetic reed for reed-blown wind instruments comprising an oriented semi-crystalline thermoplastic material having a longitudinal modulus and density which are similar to those of cane.

6. The synthetic reed of claim 5 wherein the longitudinal modulus and density are similar to those of cane in its playing condition.

7. The synthetic reed of claim 5 wherein the orientation of the thermoplastic material is selected from the group consisting of uniaxial orientation and biaxial orientation.

8. The synthetic reed of claim 5 wherein the thermoplastic material is selected from the group consisting of polypropylene and polyethylene.

9. The synthetic reed of claim 5 wherein the thermoplastic material has substantial shrinkage in at least one direction upon heating to its melting temperature in an unrestrained state.

10. The synthetic reed of claim 5 wherein the oriented semi-crystalline thermoplastic material is uniaxially oriented and has a modulus in one direction similar to that of conditioned cane in the fibre direction, the thermoplastic material has approximately the same modulus as its isotropic precursor in all directions in a plane having the draw direction as its normal vector, and the reed has a primary vibratory axis parallel to the direction of orientation of the thermoplastic material.

11. The synthetic reed of claim 5 wherein the oriented semi-crystalline thermoplastic is biaxially oriented, the synthetic reed has a primary vibratory axis parallel to one of the directions of orientation of the thermoplastic material, the synthetic reed has a modulus in one direction similar to that of conditioned cane in the fibre direction, and at least one of the modulus and strength of the synthetic reed in a direction transverse to the primary vibratory axis is higher than that of cane in a direction transverse to the fibre direction.

12. The synthetic reed of claim 5 wherein the oriented semi-crystalline thermoplastic material is manufactured by roll-drawing, hydrostatic extrusion, ram extrusion, rolling, tensile drawing, die-drawing, compression molding or cross-rolling.

13. The synthetic reed of claim 5 wherein the oriented thermoplastic material has a density from 0.8 to 1.3 g/mL and a modulus of from 3 GPa to 14 GPa.

14. The synthetic reed of claim 5 wherein the oriented thermoplastic material has a density from 0.9 to 1.1 g/mL and a modulus of from 5 to 10 GPa.

15. A synthetic reed for reed-blown wind instruments comprising an oriented semi-crystalline thermoplastic material selected from the group consisting of polypropylene and polyethylene.

16. The synthetic reed of claim 15 wherein the thermoplastic material has substantial shrinkage in at least one direction upon heating to its melting temperature in an unrestrained state.

17. The synthetic reed of claim 15 wherein the oriented semi-crystalline thermoplastic material is uniaxially oriented and has a modulus in one direction similar to that of conditioned cane in the fibre direction, the thermoplastic material has approximately the same modulus as its isotropic precursor in all directions in a plane having the draw direction as its normal vector, and the reed has a primary vibratory axis parallel to the direction of orientation of the thermoplastic material.

18. The synthetic reed of claim 15 wherein the oriented semi-crystalline thermoplastic is biaxially oriented, the synthetic reed has a primary vibratory axis parallel to one of the directions of orientation of the thermoplastic material, the reed has a modulus in one direction similar to that of conditioned cane in the fibre direction, and at least one of the modulus and strength of the synthetic reed in a direction transverse to the primary vibratory axis is higher than that of cane in a direction transverse to the fibre direction of the cane.

19. The synthetic reed as claimed in claim 15 wherein the polypropylene comprises an oriented isotactic polypropylene.

20. The synthetic reed of claim 19 wherein the isotactic polypropylene has substantial shrinkage in at least one direction upon heating to its melting temperature in an unrestrained state.

21. The synthetic reed of claim 19 wherein the oriented isotactic polypropylene is uniaxially oriented and has a modulus in one direction similar to that of conditioned cane in the fibre direction, the oriented isotactic polypropylene has the approximately the same modulus as its isotropic precursor in all directions in a plane having the draw direction as its normal vector, and the reed has a primary vibratory axis parallel to the direction of orientation of the thermoplastic material.

22. The synthetic reed of claim 19 wherein the oriented isotactic polypropylene is biaxially oriented, the synthetic reed has a primary vibratory axis parallel to one of the directions of orientation of the thermoplastic material, the synthetic reed has a modulus in one direction similar to that of conditioned cane in the fibre direction, and at least one of the modulus and strength of the synthetic reed in a direction transverse to the primary vibratory axis is higher than that of cane in a direction transverse to the fibre direction of the cane.

* * * * *